US006276678B1

(12) United States Patent
Nottelmann et al.

(10) Patent No.: US 6,276,678 B1
(45) Date of Patent: Aug. 21, 2001

(54) CASH DRAWER FOR AN AUTOMATIC TELLER

(75) Inventors: Ulrich Nottelmann, Bad Driburg; Guenter Holland-Letz, Paderborn, both of (DE)

(73) Assignee: Wincor Nixdorf GmbH & Co. KG, Paderborn (DE)

( * ) Notice: Subject to any disclaimer, the term of this patent is extended or adjusted under 35 U.S.C. 154(b) by 0 days.

(21) Appl. No.: 09/529,833

(22) PCT Filed: Sep. 8, 1998

(86) PCT No.: PCT/DE98/02646

§ 371 Date: Apr. 19, 2000

§ 102(e) Date: Apr. 19, 2000

(87) PCT Pub. No.: WO99/24939

PCT Pub. Date: May 20, 1999

(30) Foreign Application Priority Data

Nov. 5, 1997 (DE) ..... 197 48 864

(51) Int. Cl.[7] ..... B65H 5/22

(52) U.S. Cl. ..... 271/3.01; 271/117; 271/315

(58) Field of Search ..... 271/3.01, 3.04, 271/3.05, 117, 187, 315, 220

(56) References Cited

U.S. PATENT DOCUMENTS 4,787,617 * 11/1988 Ebihara ..... 271/3.05
4,854,452 * 8/1989 Uchida et al. ..... 271/3.05 X
4,883,183 11/1989 Kimura et al. ..... 109/534
4,962,919 * 10/1990 Azuchi et al. ..... 271/3.01
5,657,980 * 8/1997 Cargill et al. ..... 271/3.05

FOREIGN PATENT DOCUMENTS 196 09 866 9/1997 (DE) .
0 503 636 9/1992 (EP) .
2 005 639 4/1979 (GB) .
2 146 383 4/1985 (GB) .
2 236 524 4/1991 (GB) .

* cited by examiner

*Primary Examiner*—David H. Bollinger
(74) *Attorney, Agent, or Firm*—McCormick, Paulding & Huber LLP

(57) ABSTRACT

A dispensing compartment for an automatic cash dispensing/depositing machine, having a base (26) and a removal opening which can be closed off by a closure flap (16), is designed as a module which can be inserted into the machine, comprising a frame (10) which has the removal opening and, arranged on said frame, the closure flap (16) which can be adjusted between its open position, in which it releases the removal opening, and its closed position, in which it closes off the removal opening, also comprising the compartment base (26), a stacking device (100) for setting down banknotes on the compartment base (26), a separating device (38) for drawing off banknotes from the compartment base (26), a first transporting path (72, 80, 90) for conveying banknotes from a first connection location of the module to the stacking device (100), a second transport path (101, 90, 80) for conveying banknotes from a second connection location (105) of the module to the stacking device (100), and a third transporting path (56) for conveying banknotes from the separating device (38) to the first connection location (68).

8 Claims, 4 Drawing Sheets

CASH DRAWER FOR AN AUTOMATIC TELLER

BACKGROUND OF THE INVENTION

The invention relates to a dispensing compartment for an automatic cash dispensing/depositing machine, having a base and a removal opening which can be closed off by a closure flap.

In an automatic cash dispensing machine, on the one hand, the cash requested by the customer has to be provided so that it can be removed by the customer once the closure flap has been opened. On the other hand, it has to be possible for banknotes which the customer has not removed from the compartment following a certain period of time to be drawn in again. In an automatic cashing dispensing/depositing machine, furthermore, it has to be possible to return to the customer the banknotes which, for whatever reason, have been deemed unacceptable, be this because they are possibly not authentic, they belong to a foreign currency for which the machine is not suitable, they are damaged mechanically or are provided with foreign bodies such as paper clips or adhesive tape.

Performance of the above-described functions requires various high-outlay devices which have to be arranged in the region of the dispensing compartment. In the known automatic cash dispensing/depositing machines, these devices involve relatively high outlay, require a large amount of space and are difficult to adjust and to maintain.

The object of the invention is to specify a dispensing compartment of the type mentioned in the introduction in which the devices which are necessary for performing the above-mentioned functions require less space and are easier to adjust and to maintain.

This object is achieved according to the invention in that the dispensing compartment is designed as a module which can be inserted into the machine, comprising a frame which has the removal opening and, arranged on said frame, the closure flap which can be adjusted between its open position, in which it releases the removal opening, and its closed position, in which it closes off the removal opening, also comprising the compartment base, a stacking device for setting banknotes on the compartment base, a separating device for drawing off banknotes from the compartment base, a first transporting path for conveying banknotes from a first connection location of the module to the stacking device, a second transporting path for conveying banknotes from a second connection location of the module to the stacking device, and a third transporting device for conveying banknotes from the separating device to the first connection location.

The module is a self-contained unit which can perform all the functions described in the introduction. All that is required is for the machine to provide a first connection location, at which banknotes are transported from a banknote store of the machine to the module and/or at which banknotes are conveyed from the module to a banknote store of the machine. Furthermore, it is necessary to provide a second connection location, at which the banknotes rejected during the checking operation are transferred to the module.

The module may be prefabricated as a single unit. This allows a considerably more compact arrangement of the components since they can be better adapted to one another than was the case with the conventional machines. Furthermore, the module may be removed as a single unit for adjustment and maintenance purposes. The individual components are thus more easily accessible and can be maintained and adjusted more easily.

The stacking device may be, in a manner known per se, a stacking wheel which is mounted in the frame such that it can be rotated about a spindle which is parallel to the compartment base.

The compartment base may advantageously be adjusted between a stacking position, in which the banknotes can be set down on the compartment base by the stacking device, and a drawing-off position, in which the separating device can grip the respectively lowermost banknote resting on the compartment base. It is preferable here for the compartment base to be prestressed into its stacking position, with the result that it can be actively adjusted merely in one direction, namely in the direction of its drawing-off position.

Very straightforward adjustability of the compartment base can be achieved in that said compartment base is mounted such that it can be pivoted about a spindle located in the vicinity of the removal opening.

In order to adjust the compartment base in the direction of its drawing-off position, use is made of a pressure-exerting plate, which also assumes further functions at the same time. Said pressure-exerting plate can be adjusted between a stacking position, in which it forms a directing surface for the banknotes running into the stacking device from the first or second transporting path, and a removal position, in which at a distance from the compartment base, and more or less parallel thereto, it at least partially covers the dispensing compartment in the direction of the stacking device, and from which it can be adjusted into a pressure-exerting position, in which it rests on the uppermost banknote of a banknote stack arranged on the compartment base. In the removal position, the pressure-exerting plate thus forms at least part of the top compartment boundary and prevents the customer from being able to reach into the stacking device as he/she is removing the banknotes from the dispensing compartment. In its pressure-exerting position, said pressure-exerting plate keeps the compartment base in its drawing-off position and ensures that the separating device can reliably grip the respectively lowermost banknote of a banknote stack located on the compartment base.

The pressure-exerting plate can preferably be pivoted between its stacking position and its removal position, about a spindle parallel to the stacking-wheel spindle, and can be adjusted in a linear manner, parallel to itself, between the removal position and the respective pressure-exerting position.

In order to control the movements of the pressure-exerting plate, the invention proposes a drive mechanism which has at least one control wheel which is mounted coaxially with the pivot spindle of the pressure-exerting plate and can be adjusted by means of a drive motor between a first end position, which corresponds to the stacking position of the pressure-exerting plate, an intermediate position, which corresponds to the removal position of the pressure-exerting plate, and a second end position, which corresponds to the pressure-exerting position of the pressure-exerting plate, in which the pressure-exerting plate is located next to the compartment base, it being the case that the pressure-exerting plate is coupled to the control wheel via a lever and cam control mechanism such that it is forcibly adjusted as the control wheel rotates from the second end position to the first end position and from the first end position to the intermediate position, whereas, upon movement of the control wheel from the intermediate position to the second end position, the forced coupling between the control wheel and pressure-exerting plate is eliminated. In this region, in which the pressure-exerting plate is intended for resting on a banknote stack located on the compartment base, the pressure-exerting plate is preferably moved under the action of a spring which prestresses the pressure-exerting plate in the direction of the compartment base. On the one hand, this control ensures that the pressure-exerting plate is adjusted reliably between its stacking position and its removal position and is guided back reliably from its pressure-exerting position, next to the compartment base, counter to the action of the pressure-exerting spring; on the other hand, the capacity of the pressure-exerting plate to move freely in its pressure-exerting position and the spring prestressing can ensure that the pressure-exerting plate always presses with a predetermined force on the banknote stack and keeps the latter in engagement with the separating device.

Precise control can easily be achieved in that the drive motor for driving the control wheel is a stepping motor, and in that the zero point for the step counting is established by a position indicator connected to the control wheel.

In order to maintain as compact an arrangement as possible, it is expedient for the pressure-exerting plate not to be made too large. This means that the pressure-exerting plate, in the removal position, may not cover the entire dispensing compartment. For this case, it is expedient for the pressure-exerting plate, for covering the compartment, to interact with a further flap which is mounted in the vicinity of the compartment opening such that it can be pivoted about a spindle parallel to the pivot spindle of the pressure-exerting plate, and which is coupled to the control wheel via a lever/cam control mechanism such that, as the control wheel is adjusted between its first end position and its intermediate position, said flap is adjusted counter to the pivoting movement of the pressure-exerting plate.

Further features and advantages of the invention can be gathered from a following description, which explains the invention, by way of an exemplary embodiment, in conjunction with the attached drawings, in which:

DETAILED DESCRIPTION OF THE PREFERRED EMBODIMENTS

Figure 1:
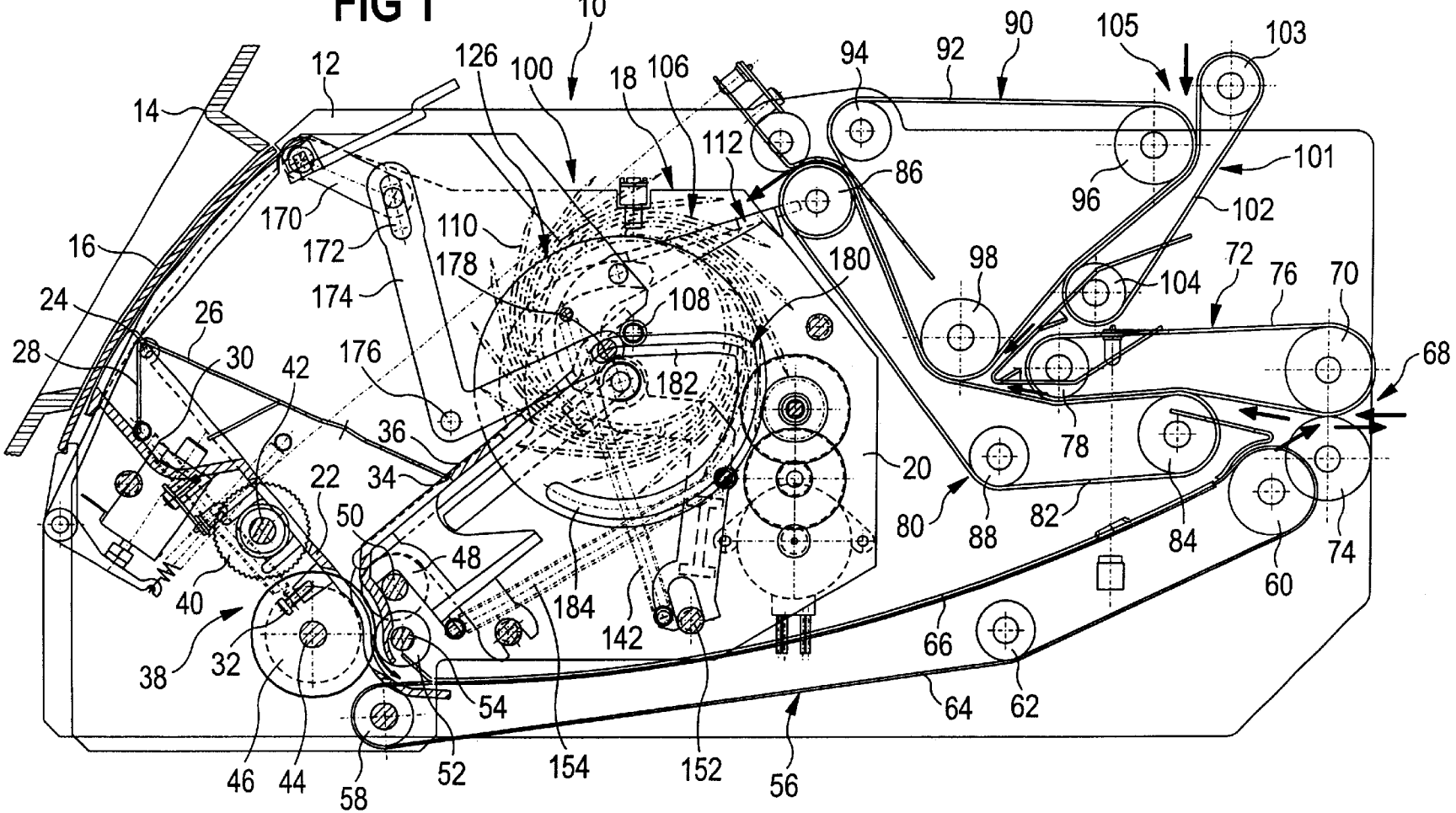
FIG. 1 shows a schematic, partially sectional side view of a compartment module according to the invention with the pressure-exerting plate in the stacking position.
Figure 2:
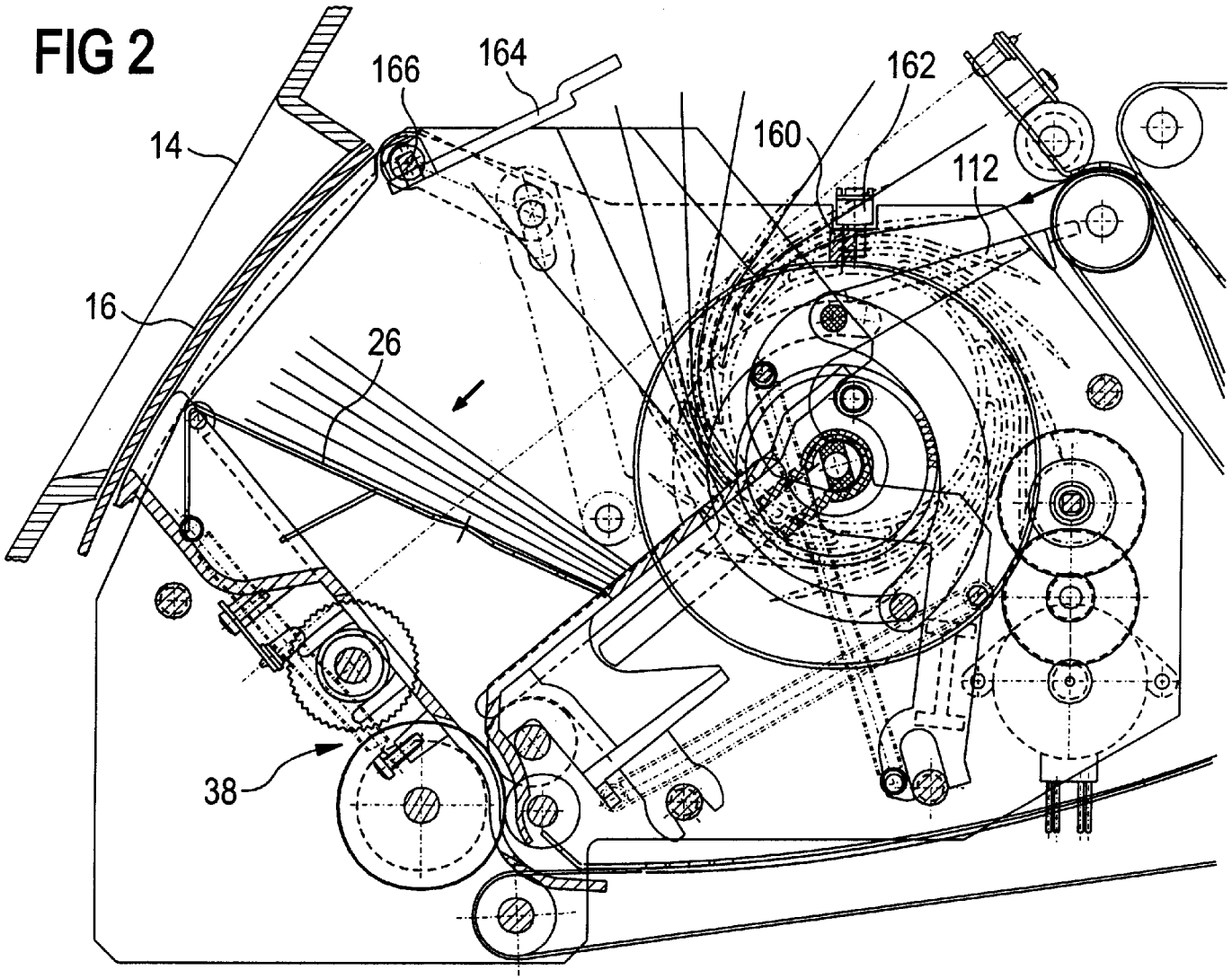
FIG. 2 shows an illustration, corresponding to FIG. 1, of the front module section during the operation of stacking banknotes on the compartment base.
Figure 3:
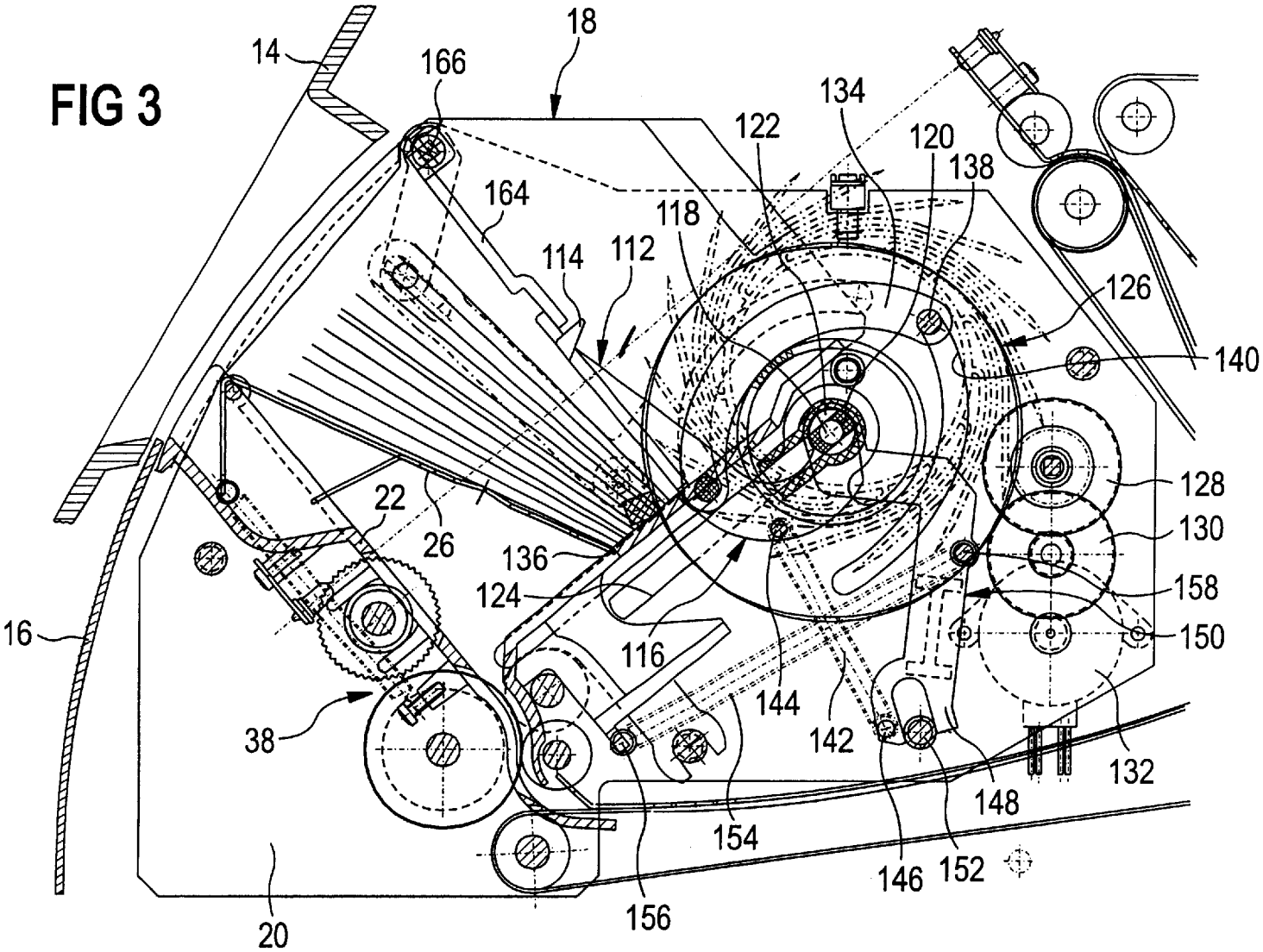
FIG. 3 shows an illustration, corresponding to FIG. 2, of the compartment module with the pressure-exerting plate in its removal position and with the closure flap open.
Figure 4:
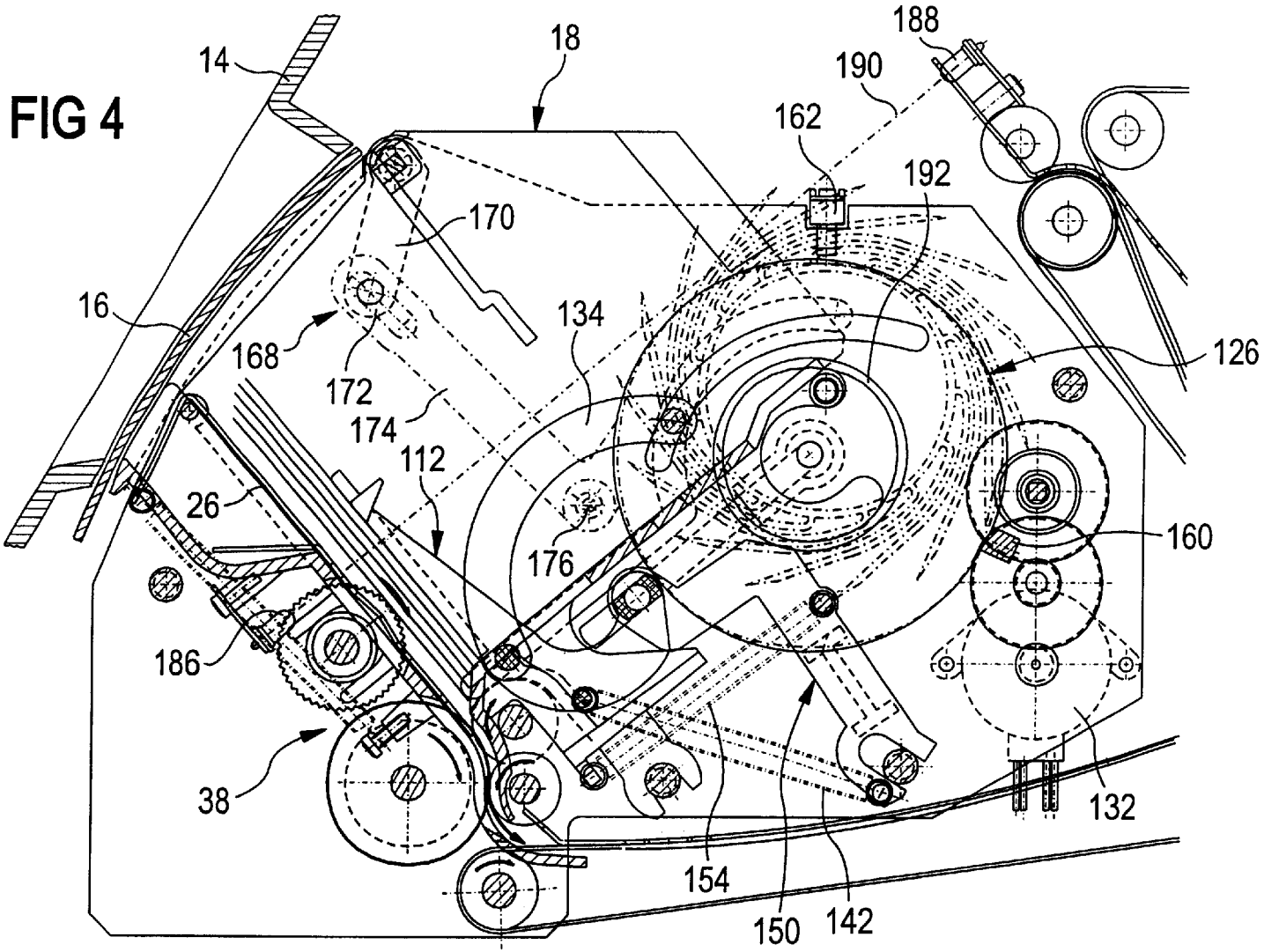
FIG. 4 shows an illustration, corresponding to FIGS. 2 and 3, of the compartment module with the closure flap closed and with the pressure-exerting plate in its pressure-exerting position.

The dispensing-compartment module illustrated in FIG. 1 comprises an outer module frame which is designated 10 in general terms and has two outer frame walls 12, of which only one is illustrated here and which are connected to one another in a manner which is not illustrated specifically. Arranged in front of the module frame 10 is an opening frame 14 which is inserted into a corresponding opening in a housing of an automatic cash dispensing/depositing machine and bounds the removal opening of the dispensing compartment. Furthermore, the removal opening is closed off by a curved closure flap 16 which can be adjusted, via an actuating mechanism (not illustrated), between the closed position, which is illustrated in FIGS. 1, 2 and 4, and the open position, which is illustrated in FIG. 3 and in which the dispensing compartment is accessible.

Arranged between the side walls 12 of the outer module frame is an inner frame 18, of which likewise only one of two frame side walls 20 is illustrated here, these being connected to one another by an assembly part 22 directed transversely to them. The assembly part 22 forms a frame-mounted bottom boundary for the dispensing compartment.

Running in the plane of the assembly part 22, and in the vicinity of the closure flap 16, is a pivot spindle 24 which is directed parallel to said closure flap, a compartment base 26 being mounted such that it can be pivoted about said pivot spindle 24. The compartment base 26 comprises a metal plate from which a leg 28 projects at an acute angle in the region of the pivot spindle 24. Acting on said leg is a tension spring 30, which has its other end fitted on a pin 32 which is fixed to the assembly part 22. The tension spring 30 prestresses the compartment base 26 in the counterclockwise direction in FIG. 1, with the result that it lifts off from the assembly part 22. The pivoting movement is limited in that the compartment base 26 strikes by way of its free edge, which is remote from the pivot spindle 24, against a stop 34, which is formed on a second frame-mounted assembly part 36.

A separating device designated 38 in general terms is arranged in the region of the assembly part 22, beneath the compartment base 26. It comprises drawing-off rollers 40 which, through slits (not illustrated) in the compartment base 26, can come into contact with the lowermost banknote of a banknote stack resting on the compartment base 26, as will be explained in more detail below by way of FIG. 4. The drawing-off rollers 40 are arranged in a rotationally fixed manner on a shaft 42, extending transversely between the side walls 20 of the inner frame 18, and can be driven by said shaft.

Extending parallel to the shaft 42 is a shaft 44, on which rapidly circulating drive rollers 46 are arranged. These interact with stripper rollers 48 which circulate slowly in the opposite direction, on a shaft 50 parallel to the shaft 44, in order to prevent two banknotes from being drawn off at the same time. Located downstream of the nip formed by the rollers 46 and 48 are transporting rollers 52, which are arranged on a shaft 54, parallel to the shaft 44, and transfer to a belt conveyor 56 banknotes which have been drawn off by the separating device 38, said belt conveyor comprising an endless belt 64 which runs over end rollers 58, 60 and intermediate rollers 62 and of which one strand forms, with a directing plate 66, a conveying gap for the banknotes drawn off by the separating device. The belt conveyor 56 extends from the separating device 38 to a first connection or transfer location 68 at the rear end of the module frame 10.

The transfer location 68 is formed by end rollers 70 of a second belt conveyor 72 and mating rollers 74 which interact with the end rollers 70. The belt conveyor 72 comprises a belt 76 which extends, on the one hand, over the end rollers 70 and, on the other hand, over end rollers 78. The belt conveyor 72 interacts with one section of a further belt conveyor 80, of which the belt 82 extends over end rollers 84 and 86 and intermediate rollers 88. The other section of said further belt conveyor 80 interacts with a further belt conveyor 90, of which the belt 92 extends over rollers 94, 96 and 98 arranged in a triangle. The belt conveyor 72, 80 and 90 together form a transporting path for conveying banknotes from the transfer location 68 to a stacking device 100, which will be explained in more detail below.

A section of the belt conveyor 90 interacts with a further belt conveyor 101, of which the belt 102 extends over end rollers 103 and 104. The belt conveyors 101, 90 and 80 together form a transporting path which connects to the stacking device 100 a second transfer location 105 for banknotes entering the dispensing-compartment module.

The stacking device 100 comprises a plurality of spaced-apart stacking wheels 106 which are known per se, are arranged axially one beside the other and can be rotated about a spindle 108. The banknotes introduced between the tangentially directed plastic tongues 110 of the rapidly circulating stacking wheels 106 are set down on the compartment base 26 following a partial rotation of the stacking wheels 106. The arrangement and control of a pressure-exerting plate, designated 112 in general terms, will now be explained hereinbelow with reference to FIGS. 2 to 4.

The pressure-exerting plate 112 comprises a plurality of sections (not illustrated) between which the stacking wheels 106 can pass through and which are connected to one another by a crosspiece 114. At the outer borders, the pressure-exerting plate 112 is connected to curved levers 116 which, in the vicinity of their shorter, free leg, each bear a rotary pin 118. The two rotary pins 118 form a spindle about which the pressure-exerting plate 112 is mounted in a pivotable manner between the two side walls 20 of the inner frame 18. The pins 118 are each enclosed by a sliding block 120, of which the width, in one direction, corresponds to the diameter of the respective pin 118 and which projects radially beyond the pin 118 in the direction perpendicular thereto. The sliding blocks 120 are mounted in a rotatable manner in bores 122 in the side walls 20. These bores 122 are adjoined in each case by a groove 124 which extends in the direction of the assembly part 22, essentially perpendicularly to the latter, and of which the width corresponds to the diameter of the pin 118, with the result that the latter and/or the sliding block 120 can slide longitudinally in the groove 124.

In each case one control wheel 126 formed by a gearwheel is mounted in a rotatable manner on the side walls 20, coaxially with the pressure-exerting plate 112. Said control wheel may be driven by a stepping motor 132 via a gearwheel 128, which engages with the control wheel, and an intermediate gearwheel 130.

The control wheel 126 is connected to the pressure-exerting plate 112 via a coupling lever 134 which is curved in the form of an arc of a circle and of which one end is articulated on the pressure-exerting plate 112 such that it can be pivoted about an articulation spindle 136, and of which the other end bears a pin 138 which engages in a curved groove 140 formed in the control wheel 126. However, the curvature of the groove 140 is not coaxial with the rotary spindle 118 of the control wheel 126.

The pressure-exerting plate 112 is prestressed by a tension spring 142, of which one end acts on a pin 144 on the pressure-exerting plate 112, said pin being located between the rotary pin 118 and the articulation pin 124, and of which the other end acts at 146 on a fork head 148 of an angle lever 150. The latter engages, by way of the fork head 148, around a pin 152, which is arranged on a side wall 20 of the inner frame 18, and is mounted, by way of its other end, on the rotary pin 118 of the pressure-exerting plate 112. A further tension spring 154, on the one hand, is arranged at a framework-mounted point 156 in the vicinity of the transporting roller 52 of the separating device 38 and, on the other hand, acts at a location 158 located approximately in the center between the two ends of the angle lever 150.

The device described thus far operates as follows:

FIG. 2 shows the dispensing-compartment module according to the invention during the operation of stacking banknotes on the compartment base 26. The former may be banknotes which are transported to the stacking device 100 from a store of the automatic cash dispensing machine, via the transfer location 68 and the belt conveyors 72, 80 and 90, or else from a depositing compartment located above the dispensing-compartment module, via the transfer location 105 and the belt conveyors 101, 90 and 80. The banknotes are stripped off from the stacking wheels 106 onto the compartment base 26 and are positioned on the resiliently mounted compartment base.

In this position, the pressure-exerting plate 112 has been swung clockwise in the upward and rearward direction and forms a directing surface for the banknotes running into the stacking wheels 106, in order to prevent said banknotes from dropping rearward into the module. The control wheel 126 is likewise rotated clockwise into a first end position. In this end position, a radial tongue 160 (FIG. 2), which is connected to the control wheel 126, passes into a fork-type light barrier 162 which is connected to the control means for the stepping motor 132. The signal which is produced by the fork-type light barrier 162 in this position of the control wheel and by the tongue 160 connected thereto defines a zero position for the stepping motor 132, from which it is possible to count the steps for the adjustment of the control wheel 126.

Once all the banknotes have been set down on the compartment base 26, the pressure-exerting plate 112 is pivoted in the counterclockwise direction into the position illustrated in FIG. 3. This takes place by the control wheel 126 being rotated in the counterclockwise direction by the stepping motor 132, via the gearwheels 130 and 128, with the result that the pressure-exerting plate 112 can be pivoted, under the action of the tension spring 142, in the counterclockwise direction as far as is permitted by the coupling of the control wheel 126 via the coupling lever 134. In this case, the position of the sliding block 120 permits the rotary pin 118 merely to rotate, and prevents displacement along the groove 124.

In the position illustrated in FIG. 3, the pressure-exerting plate 112 is directly at least more or less parallel to the compartment base 26 and the assembly part 22 and conceals the stacking device 100. The covering is completed by a further flap 164, which interacts with the pressure-exerting plate 112 is mounted in the vicinity of the closure flap 16 such that it can be pivoted about a pivot spindle 166, and can be pivoted, via a lever linkage 168, between the closed position, which is illustrated in FIG. 3, and the open position, which is illustrated in FIG. 2. The lever linkage 168 comprises a first lever 170, which is connected in a rotationally fixed manner to the flap 164 and, at its free end, is connected in an articulated manner to one end of an angle lever 174 via a pin/slot connection 172. Said angle lever is mounted, at its angle vortex, on a side wall 20 of the inner frame 18 such that it can be rotated about a spindle 176 and, at the free end of its other leg, bears a pin 178 by way of which it engages in a control groove 180 formed on the control wheel 126. Said control groove comprises a more or less radially running branch 182 and a branch 184 which runs coaxially with the rotary spindle 118 of the control wheel 126. Upon transfer from the release position of the flap 164, which is illustrated in FIG. 2, to the covering or closed position of the flap 164, which is illustrated in FIG. 3, the pin 178 runs through the radial branch 182 of the control groove 180.

Finally, in the position of FIG. 3, the closure flap 16 is transferred downward, again via a motor (not illustrated) into its open position, with the result that the customer can then remove the banknote bundle set down on the compartment base 26. Whether or not the banknotes have been removed in their entirety from the dispensing compartment can be detected with the aid of a light barrier which comprises a light source 186 and a light receiver 188, the light beam 190 passing through gaps in the compartment base 26 and the pressure-exerting plate 112, said gaps being provided in the relevant parts for the drawing-off rollers 40 and the stacking wheels 106, respectively.

If it is established by means of a light barrier 186, 188 that the customer has not removed the banknotes, or has not removed them in their entirety, within a predetermined period of time, then these banknotes are drawn into the machine from the dispensing compartment. For this purpose, first of all the closure flap 16 is closed again in accordance with FIG. 4.

Thereafter, the control wheel 126 is rotated in the counterclockwise direction from the position illustrated in FIG. 3 into the position illustrated in FIG. 4. This releases the pressure-exerting plate 112, which then, under the action of the tension springs 154 and 142, executes a linear movement parallel to itself, the sliding block 120 sliding in the groove 124. The pressure-exerting plate 112 then presses the banknote stack, together with the compartment base 26, against the assembly part 22, the drawing-off rollers 40 passing through the slits in the compartment base 26 and coming into contact with the lowermost banknote of the banknote stack. The rollers of the separating device 38 are then driven in the direction of the depicted arrows, with the result that the banknotes of the stack are drawn off individually. The banknotes are then transported, via the belt conveyor 56, to the first transfer location 68, and are transferred there to a banknote conveyor, of the machine, which transports them to a store or to a reject compartment.

Once all the banknotes have been drawn off from the compartment base 26, the pressure-exerting plate 112 can be pivoted into the starting position again in accordance with FIGS. 1 and 2. For this purpose, the control wheel 126 is pivoted in the clockwise direction by the stepping motor 132, the coupling lever 134 being carried along by the left-hand end of the groove 140 and, for its part, drawing the pressure-exerting plate 112 in the linear groove 124 in the direction of the center point of the control wheel 126. When the sliding block 120 is located in the central bore 122, the coupling lever 134 is supported on a collar 192 concentric with the rotary spindle 108, as FIG. 3 shows. As the control wheel 126 continues to rotate, the pressure-exerting plate 112, rather than be moved in a linear manner, is pivoted in the clockwise direction about its pivot pin 118 until it has reached the position illustrated in FIGS. 1 and 2. Simultaneously with this movement, the flap 164 is pivoted from the closed position, which is illustrated in FIG. 3, into the open position, which is illustrated in FIGS. 1 and 2.

The angle lever 150, which extends over the entire module width, has been introduced in order to form a more favorable spring excursion for the tension spring 154 and to give the pressure-exerting plate 112, via the common point of rotation, a higher level of rigidity and more precise alignment, since, with the exception of small crosspieces, the pressure-exerting plate 112 is subdivided by the stacking wheels 106 a number of times.

| List of designations | |
|---|---|
| 10 | Module frame |
| 12 | Frame wall |
| 14 | Opening frame |
| 16 | Closure flap |
| 18 | Inner frame |
| 20 | Frame side wall |
| 22 | Assembly part |
| 24 | Pivot spindle |
| 26 | Compartment base |
| 28 | Leg |
| 30 | Tension spring |
| 32 | Pin |
| 34 | Stop |
| 36 | Assembly part |
| 38 | Separating device |
| 40 | Drawing-off rollers |
| 42 | Shaft |
| 44 | Shaft |
| 46 | Drive rollers |
| 48 | Stripper rollers |
| 50 | Shaft |
| 52 | Transporting rollers |
| 54 | Shaft |
| 56 | Belt conveyor |
| 58 | End rollers |
| 60 | End rollers |
| 62 | Intermediate rollers |
| 64 | Endless belt |
| 66 | Directing plate |
| 68 | Connection location |
| 70 | End rollers |
| 72 | Belt conveyor |
| 74 | Mating rollers |
| 76 | Belt |
| 78 | End rollers |
| 80 | Belt conveyor |
| 82 | Belt |
| 84 | End rollers |
| 86 | End rollers |
| 88 | Intermediate rollers |
| 90 | Belt conveyor |
| 92 | Belt |
| 94 | Rollers |
| 96 | Rollers |
| 98 | Rollers |
| 100 | Stacking device |
| 101 | Belt conveyor |
| 102 | Belt |
| 103 | End rollers |
| 104 | End rollers |
| 105 | Transfer location |
| 106 | Stacking wheel |
| 108 | Spindle |
| 110 | Plastic tongues |
| 112 | Pressure-exerting plate |
| 114 | Crosspiece |
| 116 | Lever |
| 118 | Rotary pin |
| 120 | Sliding block |
| 122 | Bore |
| 124 | Groove |
| 126 | Control wheel |
| 128 | Gear wheel |
| 130 | Intermediate gear wheel |
| 132 | Stepping motor |
| 134 | Coupling lever |
| 136 | Articulation spindle |
| 138 | Pin |
| 140 | Groove |
| 142 | Tension spring |
| 144 | Pin |
| 146 | Fastening location |

-continued

| List of designations | |
|---|---|
| | on the fork head |
| 148 | Fork head |
| 150 | Angle lever |
| 152 | Pin |
| 154 | Tension spring |
| 156 | Framework-mounted point |
| 158 | Location on the angle lever |
| 160 | Radial tongue |
| 162 | Fork-type light barrier |
| 164 | Flap |
| 166 | Pivot spindle |
| 168 | Lever linkage |
| 170 | Lever |
| 172 | Pin/slot connection |
| 174 | Angle lever |
| 176 | Spindle |
| 178 | Pin |
| 180 | Control groove |
| 182 | Radial branch |
| 184 | Coaxial branch |
| 186 | Light source |
| 188 | Light receiver |
| 190 | Light beam |
| 192 | Collar |

What is claimed is:

1. A dispensing compartment for an automatic cash dispensing/depositing machine, having a supporting plate (26), having a stacking device (100) for depositing banknotes on the supporting plate (26), the stacking device (100) comprising at least one stacking wheel (106) which is mounted such that it can be rotated about a spindle (108) which is parallel to the supporting plate (26), and having a removal opening which can be closed off by a closure flap (16) which can be adjusted between its open position, in which it releases the removal opening, and its closed position, in which it closes off the removal opening, and also having a separating device (38) for drawing off banknotes from a compartment base (26), a first transporting path (72, 80, 90) for conveying banknotes to the stacking device (100), and a third transporting path (56) for conveying banknotes from the separating device (38) to a banknote conveyor, characterized in that the compartment base (26) is mounted such that it can be pivoted about a spindle (24) located in the vicinity of the removal opening, in that the compartment base (26) forms the supporting plate in a stacking position and can be adjusted between the stacking position, in which banknotes can be deposited on the compartment base (26) by the stacking device (100), and a drawing-off position, in which the separating device (38) can grip the respectively lowermost banknote resting on the compartment base (26), and in that there is provided a pressure-exerting plate (112) which can be adjusted between a stacking position, in which it forms a directing surface for the banknotes running into the stacking device (100) from the first or second transporting path (72, 80, 90 or 101, 80, 90, respectively), and a removal position, in which at a distance from the compartment base (26) and more or less parallel thereto, it at least partially covers the dispensing compartment in the direction of the stacking device (100), and from which it can be adjusted into a pressure-exerting position, in which it rests on the uppermost banknote of a banknote stack arranged on the compartment base (26).

2. The dispensing compartment as claimed in claim 1, characterized in that the pressure-exerting plate (112) can be pivoted between its stacking position and its removal position, about a spindle parallel to the stacking-wheel spindle, and can be adjusted in a linear manner, parallel to itself, between the removal position and the respective pressure-exerting position.

3. The dispensing compartment as claimed in claim 1, characterized in that a drive mechanism for the pressure-exerting plate (112) has at least one control wheel (126) which is mounted coaxially with the pivot spindle (118) of the pressure-exerting plate (112) and can be adjusted by means of a drive motor (132) between a first end position, which corresponds to the stacking position of the pressure-exerting plate (112), an intermediate position, which corresponds to the removal position of the pressure-exerting plate (112), and a second end position, which corresponds to the pressure-exerting position of the pressure-exerting plate (112), in which the latter is located next to the compartment base (26), and in that the pressure-exerting plate (112) is coupled to the control wheel (126) via a lever and cam control mechanism (134, 138, 140) such that it is forcibly adjusted as the control wheel (126) rotates from the second end position to the first end position and from the first end position to the intermediate position, whereas, upon movement of the control wheel (126) from the intermediate position to the second end position, the forced coupling between the control wheel (126) and the pressure-exerting plate (112) is eliminated.

4. The dispensing compartment as claimed in claim 3, characterized in that the pressure-exerting plate (112) is prestressed in the direction of the compartment base (26).

5. The dispensing compartment as claimed in claim 3, characterized in that the drive motor (132) is a stepping motor, and in that the zero point for the step counting is established by a position indicator (160) connected to the control wheel (126).

6. The dispensing compartment as claimed in claim 3, characterized in that the pressure-exerting plate (112), for covering the compartment, interacts with the second flap (164) which is mounted in the vicinity of the compartment opening such that it can be pivoted about a spindle (166) directed parallel to the pivot spindle of the pressure-exerting plate (112), and which is coupled to the control wheel (126) via a lever and cam control mechanism (168, 178, 180) such that, as the control wheel (126) is adjusted between its rest end position and its intermediate position, said flap is adjusted counter to the pivoting movement of the pressure-exerting plate 112).

7. The dispensing compartment as claimed in claim 1, characterized in that the compartment base (26) is prestressed into its stacking position.

8. The dispensing compartment as claimed in claim 1, characterized in that it is designed as a module which can be inserted into the machine, comprising a frame (10) which has the removal opening and, arranged on said frame, at least the closure flap (16), also comprising the compartment base (26), the stacking device (100), the separating device (38), the first transporting path (72, 80, 90), a second transporting path (101, 90, 80) for conveying banknotes from a second connection location (105) of the module to the stacking device (100), and the third transporting path (56), the first transporting path (72, 80, 90) and the third transporting path (56) opening out at a first connection location (68), which is common to both.

* * * * *